US007623085B1

(12) United States Patent
Lier

(10) Patent No.: US 7,623,085 B1
(45) Date of Patent: Nov. 24, 2009

(54) ARTIFICIAL DIELECTRIC ANTENNA ELEMENTS

(75) Inventor: Erik Lier, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 12/062,453

(22) Filed: Apr. 3, 2008

Related U.S. Application Data

(62) Division of application No. 11/270,520, filed on Nov. 10, 2005, now Pat. No. 7,379,030.

(60) Provisional application No. 60/626,865, filed on Nov. 12, 2004.

(51) Int. Cl.
*H01Q 13/00* (2006.01)

(52) U.S. Cl. ..... 343/786; 343/772; 343/771; 343/773

(58) Field of Classification Search ..... None
See application file for complete search history.

(56) References Cited

U.S. PATENT DOCUMENTS

| | | | | |
|---|---|---|---|---|
| 2,650,985 | A | 9/1953 | Noel, et al. | |
| 4,246,584 | A | 1/1981 | Noerpel | |
| 4,783,665 | A | 11/1988 | Lier et al. | |
| 5,117,240 | A | 5/1992 | Anderson et al. | |
| 5,166,698 | A | 11/1992 | Ashbaugh et al. | |
| 5,642,122 | A | 6/1997 | Lockie et al. | |
| 6,020,859 | A | 2/2000 | Kildal | |
| 6,266,025 | B1 | 7/2001 | Popa et al. | |
| 6,323,818 | B1 | 11/2001 | Koh et al. | |
| 6,441,795 | B1 * | 8/2002 | Volman | 343/786 |
| 6,456,254 | B1 | 9/2002 | Reineix et al. | |
| 6,501,433 | B2 | 12/2002 | Popa et al. | |
| 6,515,235 | B2 | 2/2003 | Moller | |
| 6,597,323 | B2 | 7/2003 | Teshirogi et al. | |
| 6,831,612 | B2 | 12/2004 | King et al. | |
| 6,879,297 | B2 | 4/2005 | Brown et al. | |
| 6,879,298 | B1 | 4/2005 | Zarro et al. | |
| 6,985,118 | B2 * | 1/2006 | Zarro et al. | 343/786 |
| 6,992,639 | B1 | 1/2006 | Lier | |
| 7,379,030 | B1 | 5/2008 | Lier | |
| 2005/0099352 | A1 * | 5/2005 | Killen et al. | 343/786 |

OTHER PUBLICATIONS

E. Lier, "A Dielectric Hybrid Mode Antenna Feed: A Simple Alternative to the Corrugated Horn", IEEE Transactions on Antennas and Propagation, Jan. 1, 1986, pp. 21-29, vol. AP-34, No. 1.

(Continued)

*Primary Examiner*—Trinh V Dinh
(74) *Attorney, Agent, or Firm*—McDermott Will & Emery LLP

(57) ABSTRACT

An artificial dielectric antenna structure for reducing the mass and insertion loss of an antenna is provided. The artificial dielectric antenna structure includes a plurality of layers of dielectric material. Each layer of dielectric material has a dielectric constant. The artificial dielectric antenna structure further includes a plurality of spacing layers interposed between the plurality of layers of dielectric material. Each of the plurality of spacing layers has a dielectric constant lower than the dielectric constant of any of the plurality of layers of dielectric material. The artificial dielectric antenna structure may be disposed within a horn antenna. The artificial dielectric antenna structure may alternately be disposed upon a transmission medium to form a dielectric resonator antenna.

21 Claims, 9 Drawing Sheets

OTHER PUBLICATIONS

E. Lier and Per-Simon Kildal, "Dielectrically Lined Horn Antennas", Workshop on Primary Feeds and RF-Sensing Systems, ESTEC, The Netherlands, Jun. 10-11, 1987.

E. Lier and Per-Simon Kildal, "Soft and Hard Horns", IEEE Transactions on Antennas and Propagation, Aug. 1988, pp. 1152-1157, vol. 36, No. 8.

"Military Space Programs: GPS Blocker II R", FAS Space Policy Project (visited Jan. 13, 2003) <http://www.fas.org/spp/military/program/nav/gps_2r.htm> (3 pages).

P.J.B. Clarricoats and A.D. Olver, "Propagation and Radiation Characteristics of Cylindrical Corrugated Waveguides", Corrugated Horns for Microwave Antennas, Chapter 3, 1984, pp. 20-57, Peter Peregrinus Ltd., London, UK.

R. J. Dewey, "Circularly Polarized Elliptical Beamshape Horn Antennas", Int. J. Electronics, 1982, pp. 101-103, vol. 53, No. 2.

Eric Lier, "Hybrid-Mode Horn Antenna with Design-Specific Aperture Distribution and Gain", presented IEEE Antennas and Propagation Society International Symposium, Jun. 22-27, 2003, Columbus, Ohio (6 pages).

T. Pratt and Charles W. Bostian, "Satellite Communications: Satellite Antennas", 1986, pp. 78-90, John Wile & Sons, New York.

Peter A. Rizzi, "Microwav Engineering: Passive Circuits," 1988, pp. 306-311, Prentice-Hall Englewood Cliffs, New Jersey.

Lier et al., "A New Class of Dielectric-Loaded Hybrid-Mode Horn Antennas with Selective Gain: Design and Analysis by Single Mode Model and Method of Moments," Jan. 2005, pp. 125-138, vol. 53, No. 1, IEEE Transactions on Antennas and Propagation.

* cited by examiner

ARTIFICIAL DIELECTRIC ANTENNA ELEMENTS

CROSS-REFERENCE TO RELATED APPLICATIONS

The present application is a divisional of U.S. patent application Ser. No. 11/270,520 entitled "ARTIFICIAL DIELECTRIC ANTENNA ELEMENTS," filed on Nov. 10, 2005 now U.S. Pat. No. 7,379,030, which in turn claims the benefit of priority under 35 U.S.C. § 119 from U.S. Provisional Patent Application Ser. No. 60/626,865 entitled "DUAL-BAND HIGH GAIN DIELECTRIC-LOADED HORN ANTENNA," filed on Nov. 12, 2004, the disclosure of both of which are hereby incorporated by reference in their entirety for all purposes.

STATEMENT REGARDING FEDERALLY SPONSORED RESEARCH OR DEVELOPMENT

Not applicable.

FIELD OF THE INVENTION

The present invention generally relates to antenna systems and, in particular, relates to dielectric-loaded antenna systems.

BACKGROUND OF THE INVENTION

Dielectric loading is used to improve the radiation performance and frequency bandwidth of an antenna. However, several drawbacks offset the advantages of dielectric loading. First, dielectric loading can cause increased insertion loss, degrading the strength of a signal. Second, dielectric loading increases the mass of an antenna system, which is particularly troublesome for antennas destined for space applications. Finally, the threat of electro-static discharge (ESD) is increased by dielectric loading.

Accordingly, what is needed is a way to increase the radiation performance and frequency bandwidth of an antenna system without incurring insertion loss, increased mass, and increased risk of ESD.

SUMMARY OF THE INVENTION

In accordance with the present invention, antennas can be loaded with an artificial dielectric antenna structure to improve radiation performance and frequency bandwidth. The artificial dielectric is implemented as a multi-sandwich structure with alternating layers of materials with higher and lower dielectric constants. The layered configuration of the artificial dielectric antenna structure allows for overall dielectric constants below 2, for example, about 1, while permitting higher dielectric constants as well. Mass is reduced by separating layers with higher dielectric constants apart from one another, using lightweight regions of lower dielectric material, such as honeycomb, or even vacuum gaps. The risk of ESD is mitigated by coating the layers of dielectric material with germanium (Ge) or a similar substance, and by providing bleed paths between the layers and to a ground.

According to one embodiment, the present invention is an artificial dielectric antenna structure for reducing the mass and insertion loss of an antenna. The artificial dielectric antenna structure includes a plurality of layers of dielectric material, each of which has a dielectric constant, and a plurality of spacing layers interposed between the plurality of layers of dielectric material. Each of the plurality of spacing layers has a dielectric constant lower than the dielectric constant of any of the plurality of layers of dielectric material.

According to another embodiment, a horn antenna of the present invention includes a conducting horn having an aperture, a throat and a longitudinal axis. The horn antenna further includes a plurality of layers of dielectric material disposed within the conducting horn and substantially normal to the longitudinal axis of the horn. Each of the plurality of layers of dielectric material has a dielectric constant. The horn antenna further includes a plurality of spacing layers interposed between the plurality of layers of dielectric material. Each of the plurality of spacing layers has a dielectric constant lower than the dielectric constant of any of the plurality of layers of dielectric material.

According to yet another embodiment, a dielectric resonator antenna of the present invention includes a first ground plate and a second ground plate, and a dielectric material disposed between the first and second ground plates. The dielectric resonator antenna further includes a first plurality of layers of dielectric material disposed substantially parallel to the first ground plate. Each of the first plurality of layers of dielectric material has a dielectric constant. The dielectric resonator antenna further includes a first plurality of spacing layers interposed between the first plurality of layers of dielectric material. Each of the first plurality of spacing layers has a dielectric constant lower than the dielectric constant of any of the first plurality of layers of dielectric material.

Additional features and advantages of the invention will be set forth in the description below, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be obvious, however, to one ordinarily skilled in the art that the present invention may be practiced without some of these specific details. In other instances, well-known structures and techniques have not been shown in detail not to obscure the present invention.

Figure 1:
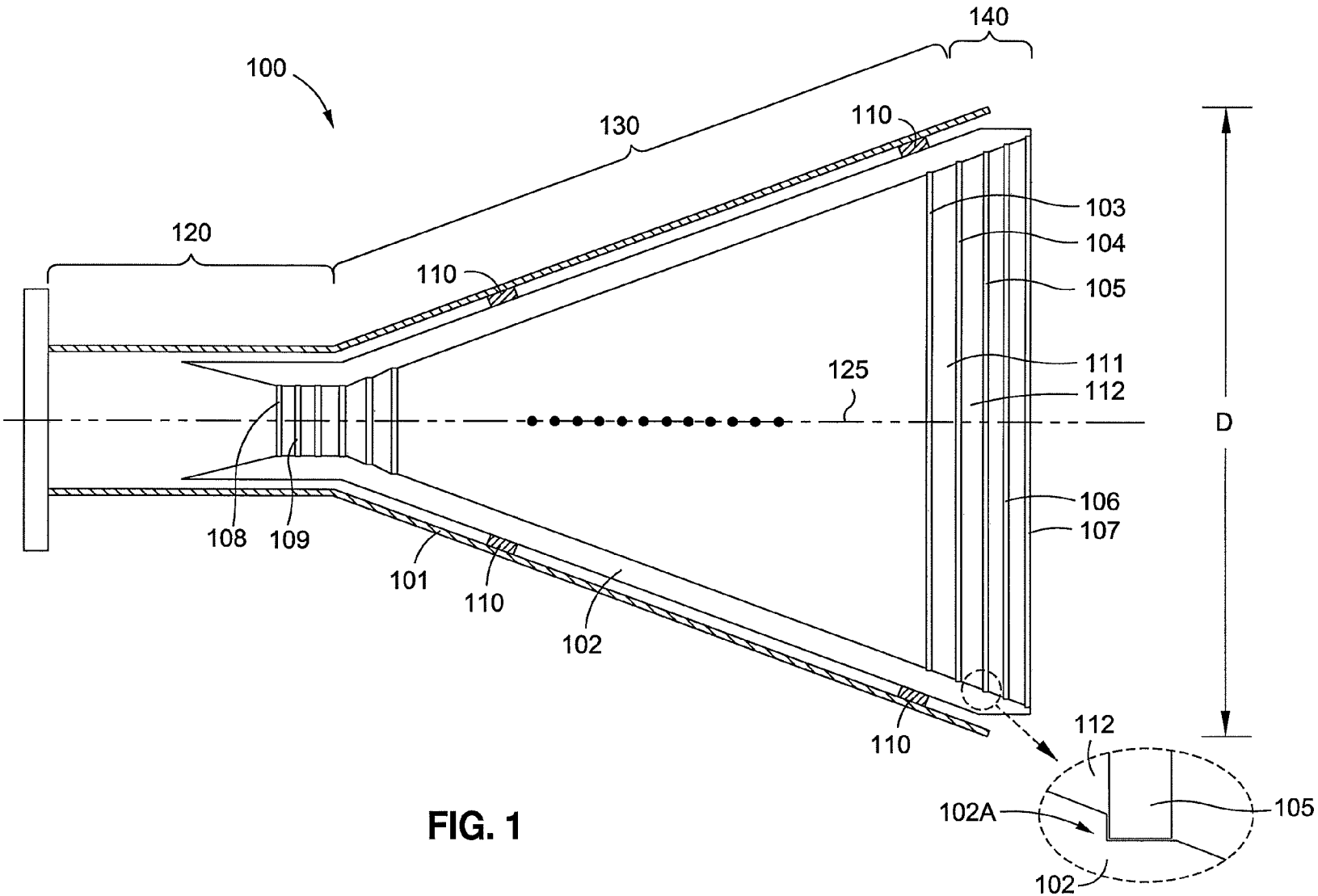
FIG. 1 illustrates a simplified diagram of a horn antenna according to one embodiment of the present invention.

FIG. 1 shows an axial cut-away view along an axis 125 of a simplified diagram of a horn antenna 100 in accordance with one embodiment of the present invention. Horn antenna 100 includes a conducting horn 101, which has an aperture 140, a tapering region 130, and a throat 120. Conducting horn 101 extends from throat 120 to define aperture 140 having a diameter D. While referred to as a "diameter," it will be appreciated by those skilled in the art that horn antenna 100 may have a variety of shapes, and that aperture 140 may be circular, elliptical, rectangular, square, polygonal, or some other configuration all within the scope of the present invention. Horn antennas of the present invention may also have different cross sectional shapes along a longitudinal axis such as axis 125, including circular, rectangular, elliptical, or the like for either circular or linear polarization. A horn antenna of the present invention may, in yet another embodiment, be implemented as a profiled horn with a non-linear graduated taper for reduced size.

Within conducting horn 101 are disposed a plurality of layers of dielectric material, such as dielectric layers 103, 104 and 105. Each of the layers of dielectric material, such as layers 103, 104 and 105, has a dielectric constant. According to one embodiment, the layers of dielectric material may include a material chosen from a group of materials with low dielectric constants such as, for example and without limitation, polystyrene, polyethylene, Teflon®, or the like. In an alternate embodiment, the layers of dielectric material may include a high-dielectric material, such as, for example and without limitation, alumina ($Al_2O_3$). The present invention is not limited to any particular dielectric materials, and may be utilized with materials having dielectric constants from about one to above several hundred or even several thousand. It will be appreciated by those skilled in the art that other alternative materials also may be used within the scope of the present invention.

According to one embodiment, all of the layers of dielectric material are made from the same dielectric material with the same dielectric constant. According to another embodiment, the layers of dielectric material may be made from different dielectric materials with different dielectric constants. For example, according to one aspect of the present invention, alternating layers of dielectric material may include two different dielectric materials with different dielectric constants. According to yet another aspect of the present invention, the horn antenna could be configured with layers of dielectric material including more than two different dielectric constants, which could be disposed to alternate between three, four, or any number of different dielectric constants. In yet another embodiment, different dielectric layers may be inserted in a variety of different configurations without being in an alternating configuration.

Referring to FIG. 1, according to one exemplary embodiment, layers of dielectric material 103, 104 and 105 are substantially planar and parallel. In alternate embodiments, layers of dielectric material may be partial spheres or partial ellipsoids, and may curve smoothly or in abrupt steps. In the present exemplary embodiment, layers of dielectric material 103, 104 and 105 are disposed substantially normal to the longitudinal axis 125 of horn antenna 100. In alternate embodiments in which layers of dielectric material are not substantially planar, portions of the layers of dielectric material may not be normal to a longitudinal axis of the horn antenna.

According to one aspect of the present invention, layers of dielectric material 103, 104 and 105 may be separated from conducting horn 101 by spacers, such as spacers 110. Spacers 110 may include a variety of shapes and sizes. For example, spacers 110 may include one or more spaced rings or ring segments, or longitudinal ridges or ridge segments, running circumferentially around the interior wall of conducting horn 101. Spacers 110 may further include axially aligned ridges or ridge segments. In still other embodiments, spacers 110 include one or more blocks, foam pieces, honeycomb spacers, and the like. In a particular embodiment, spacers 110 include a dielectric material with a low dielectric constant. In one embodiment, the axial length of the spacers is one-quarter wavelength (¼λ) of the dielectric spacer material.

Between every pair of layers of dielectric material are disposed spacing layers, each of which has a dielectric constant which is lower than the dielectric constant of any of the layers of dielectric material. In this exemplary embodiment, spacing layer 111 is interposed between layers of dielectric material 103 and 104, and spacing layer 112 is interposed between layers of dielectric material 104 and 105.

The spacing layers may include a material chosen from a group of materials with low dielectric constants such as foam, honeycomb, or the like. The spacing layers may be designed to define a gap, which may be filled with air in one embodiment, or may be in another embodiment a vacuum gap which may occur, for example, in the event horn antenna 100 is used in a vacuum, as in, for example, space. In a particular embodiment, spacing layers such as spacing layers 111 and 112 include a material having a lower dielectric constant than the material used for any of the plurality of layers of dielectric material.

According to another embodiment, the terms layers of dielectric material and spacing layers could be interchanged: the layers of dielectric material may be referred to as spacing layers, while the spacing layers may be referred to as layers of dielectric material.

An artificial dielectric thus implemented as a multi-sandwich structure with alternating layers of higher and lower dielectric constant has a resulting overall dielectric constant which is an average of the higher and lower dielectric constants after the volume of the respective layers are taken into account. According to one embodiment, there are about 4-6 layers of dielectric material per wavelength to create a uniform dielectric structure for a certain wavelength of electromagnetic radiation. By utilizing alternating layers with higher and lower dielectric constant, an overall dielectric constant can be achieved for the artificial dielectric antenna structure with substantially lower mass than would be required by a solid dielectric core having the same dielectric constant. When implemented with layers of dielectric material having a low loss tangent, the artificial dielectric core also reduces the insertion loss experienced with conventional dielectric loading, and permits the use of artificial dielectric antenna structures with overall dielectric constants less than about 2.

Maximum directivity from a horn antenna is obtained by uniform amplitude and phase distribution over the horn aperture. Such horns are denoted as "hard" horns. They can support the transverse electromagnetic (TEM) mode, and apply to linear as well as circular polarization. They are characterized with hard boundary impedances:

$$Z_z=-E_z/H_x=0 \text{ and } Zx=E_x/H_z=\infty, \quad (1)$$

or soft boundary impedances:

$$Z_z=-E_z/H_x=\infty \text{ and } Zx=E_x/H_z=0, \quad (2)$$

meeting the balanced hybrid condition:

$$Z_zZ_x=\eta_0^2, \quad (3)$$

where $\eta_0$ is the free space wave impedance and the coordinates z and x are defined as longitudinal with and transverse to the direction of the wave, respectively.

A horn antenna such as horn antenna 100 may be configured as a hard horn with uniform aperture distribution and having a high gain for a given aperture size. In an alternate embodiment, a horn antenna of the present invention may be configured as a soft horn with a $J_1(x)/x$-type aperture distribution, corresponding to low gain and low sidelobes, and having a maximum bandwidth. According to alternate embodiments, a horn antenna of the present invention may be configured as any hybrid-mode horn, supporting balanced hybrid modes, providing symmetric pattern & low cross-polarization over a large frequency band.

Referring to FIG. 1, horn antenna 100 further includes a dielectric liner 102, which is disposed between conducting horn 101 and the layers of dielectric material such as layers 103, 104 and 105. Dielectric liner 102 is separated from the horn wall by spacers 10 as described above. Dielectric liner 102 has a dielectric constant. According to one embodiment, dielectric liner 102 has a dielectric constant which is higher than the overall dielectric constant of the artificial dielectric structure defined by the plurality of layers of dielectric material and plurality of spacing layers, to provide a uniform aperture distribution and a high gain for horn antenna 100. In alternate embodiments, the dielectric liner may have a dielectric constant which is the same as or lower than the overall dielectric constant of the artificial dielectric structure. In other embodiments, the dielectric liner may have a dielectric constant which is the same as the dielectric constant of one or more layers of dielectric material.

According to one aspect, dielectric liner 102 may include machined grooves such as groove 102A for mating with layers of dielectric material such as layer 105. According to alternate aspects, a dielectric liner and layers of dielectric material may be machined from one or more solid pieces of dielectric material. By way of example, and without limitation, in an embodiment in which the dielectric constant of dielectric liner 102 and layers of dielectric material are desired to be the same, the dielectric liner 102 and layers of dielectric material may be machined from two solid pieces of dielectric material in such a way to provide a two part structure, split along a longitudinal axis of the horn antenna, so that assembly is as simple as attaching the two halves of the artificial dielectric antenna structure together.

Horn antenna 100 may also include one or more impedance matching layers, such as matching layers 106, 107, 108 and 109. Matching layers may include, for example, one or more dielectric materials coupled to dielectric liner 102 near aperture 140 or throat 120. In one embodiment, matching layers 106 and 107 near aperture 140 have a dielectric constant between the overall dielectric constant of the artificial dielectric antenna structure within horn antenna 100 and the dielectric constant of the ambient air or vacuum in which horn antenna 100 is located. In one embodiment, matching layers 106 and 107 have a axial width of about one-quarter wavelength (¼λ) of the dielectric material of which they are formed.

Figure 2:
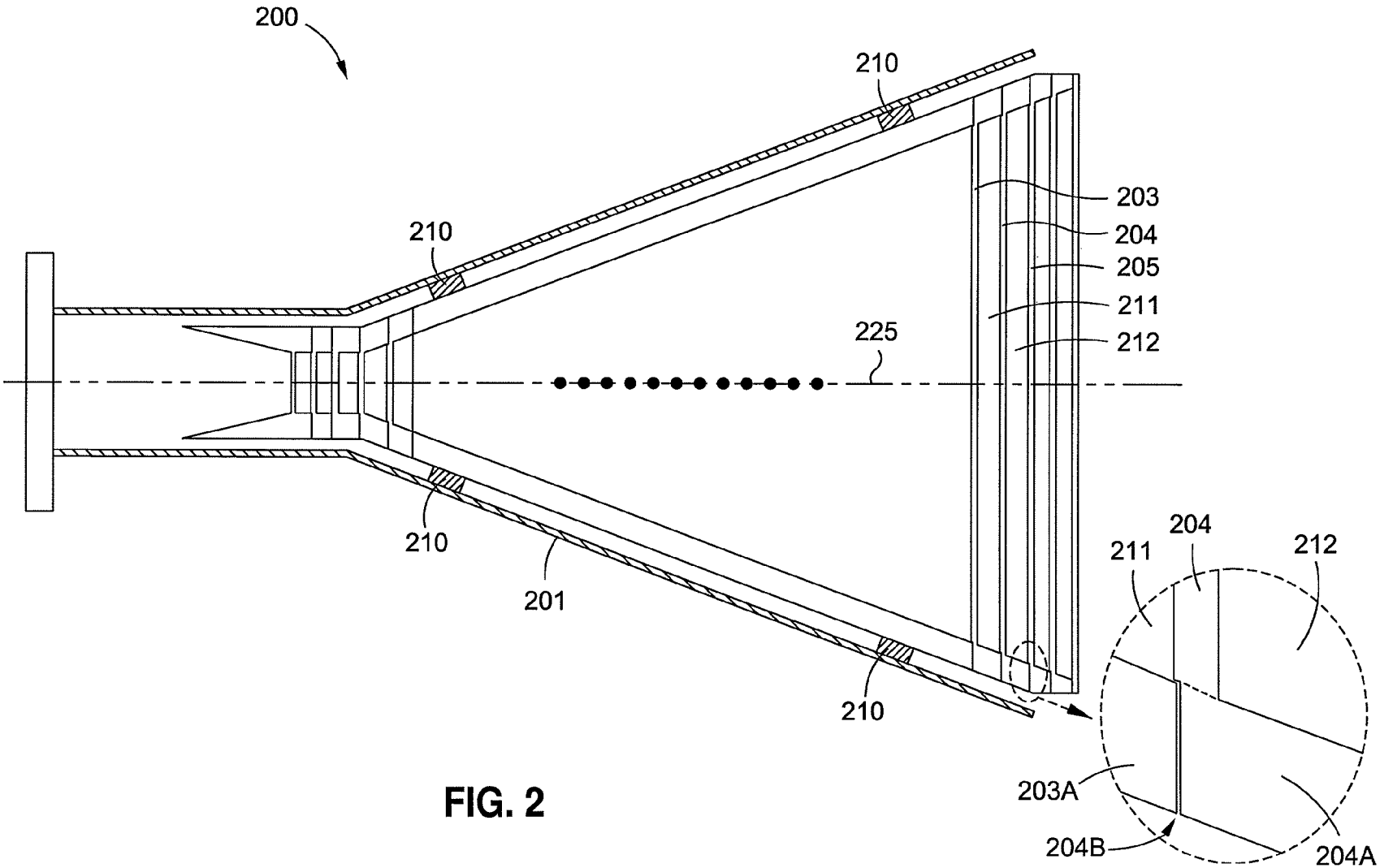
FIG. 2 illustrates a simplified diagram of a horn antenna according to one aspect of the present invention.

Now referring to FIG. 2, an axial cut-away view along an axis 225 of a simplified diagram of a horn antenna 200 is shown in accordance with another aspect of the present invention. Horn antenna 200 includes a conducting horn 201, within which are disposed a plurality of layers of dielectric material, such as dielectric layers 203, 204 and 205. Each of the layers of dielectric material, such as layers 203, 204 and 205, has a dielectric constant. Layers of dielectric material 203, 204 and 205 are disposed substantially normal to the longitudinal axis 225 of horn antenna 200, and may be separated from conducting horn 201 by spacers, such as spacers 210. Between every pair of layers of dielectric material are disposed spacing layers, each of which has a dielectric constant which is lower than the dielectric constant of any of the layers of dielectric material. In this exemplary embodiment, spacing layer 211 is interposed between layers of dielectric material 203 and 204, and spacing layer 212 is interposed between layers of dielectric material 204 and 205.

According to one embodiment, the spacing layers may include a material chosen from a group of materials with low dielectric constants such as foam, honeycomb, or the like. The spacing layers may be designed to define a gap, which may be filled with air in one embodiment, or may be a vacuum gap, in an embodiment in which horn antenna 200 is used in a vacuum, such as in space.

Each of the layers of dielectric material may include a support structure for providing separation from an adjacent dielectric layer, such as support rim 204A on layer 204. Support structures such as support rims 203A and 204A may have the same dielectric constant as the layer of dielectric material of which they are a part, or they may have a different dielectric constant. In this exemplary embodiment, support rims 203A and 204A have higher dielectric constants than those of the rest of the layers of dielectric material 203 and 204 of which they are a part. Support rim 203A may be coupled to an adjacent layer of dielectric material by an alignment structure such as alignment lip 204B, which may be implemented as a circumferential groove around the outside edge of the throat-facing side of a layer of dielectric material. In this exemplary embodiment, the support rims of the layers of dielectric material are disposed so as to define a cone shape along the edge of the layers of dielectric material.

In one embodiment, horn antenna 200 may include bleed paths (not shown) for the discharge of electrostatic build-up. Bleed paths may extend between layers of dielectric material, and from layers of dielectric material to conducting horn 201.

In one embodiment, support structures such as support rims 203A and 204A have a higher dielectric constant than that of the layer of dielectric material of which they are a part, forming a cone of dielectric material with a higher dielectric constant near the wall of conducting horn 201. In this embodiment, horn antenna 200 is configured as a hard horn with uniform aperture distribution and having a high gain for a given aperture size.

In alternate embodiments, particularly in embodiments in which the spacing layers are implemented as air or vacuum gaps, the layers of dielectric material may include other support structures, such as support columns, support rings, support ridges, or any other supporting shape for spatially separating the layers of dielectric material. Such support structures may be coupled to their respective layers of dielectric material, particularly in embodiments in which the support structures are made of a material with a different dielectric constant than the layer of dielectric material to which they are coupled. Alternately, the support structures may be implemented by machining the layer of dielectric material and the support structures from a single piece of dielectric material, particularly in an embodiment in which it is desired that both the support structures and the layer of dielectric material have a single dielectric constant. Further, the layers of dielectric material may include alignment structures which are adapted to couple with the support structures disclosed above, in the form of grooves or depressions disposed in the throat-facing surfaces of the layers of dielectric material. As will be readily apparent to one skilled in the art, the support structures and alignment structures may be implemented in any number of shapes within the scope of the present invention, and are not limited merely to rings, columns, or ridges.

Figure 3A:
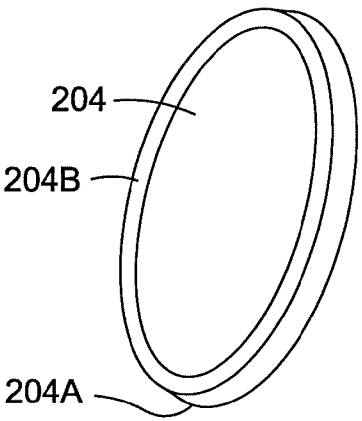
FIGS. 3A-3F illustrate layers of dielectric material according other aspects of the present invention.
Figure 3B:
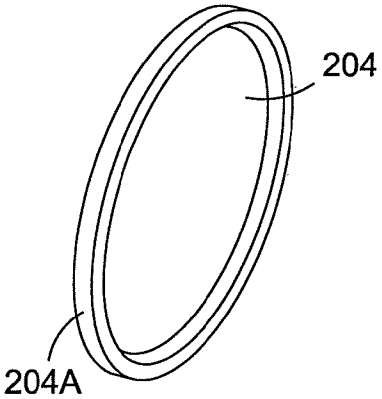

Now referring to FIGS. 3A and 3B, multiple views of a layer of dielectric material according to another aspect of the present invention are illustrated. Layer of dielectric material 204 includes support rim 204A and alignment lip 204B. Layer of dielectric material 204, including support rim 204A and alignment lip 204B, may be conformably coated with a material to combat electrostatic discharge (ESD), such as, for example, germanium (Ge). As will be appreciated by one skilled in the art, alternate coating materials may be utilized within the scope of the present invention.

Figure 3C:
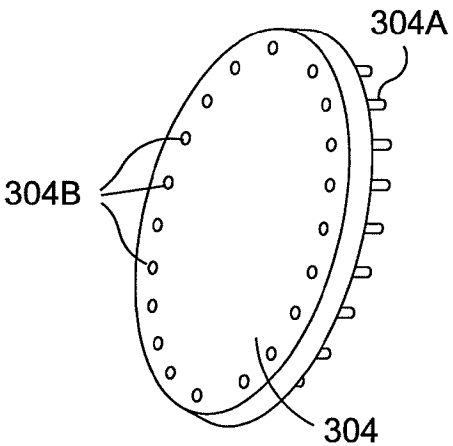
Figure 3D:
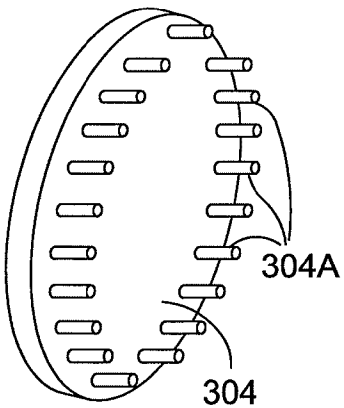
Figure 3E:
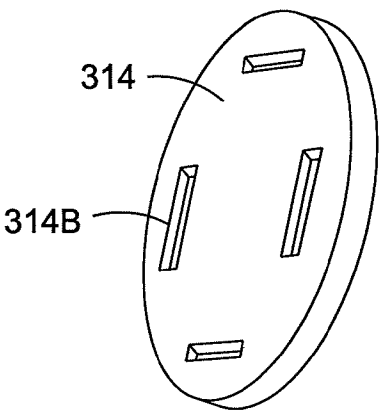
Figure 3F:
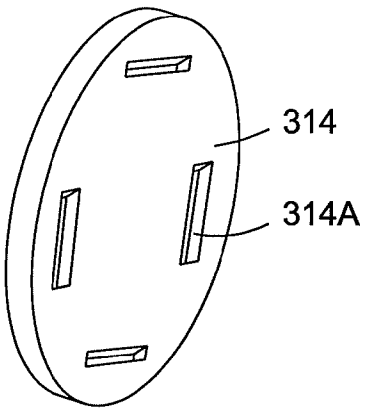

Referring now to FIGS. 3C and 3D, multiple views of a layer of dielectric material according to yet another aspect of the present invention are illustrated. Layer of dielectric material 304 includes support columns such as support columns 304A and alignment holes such as alignment holes 304B. Turning to FIGS. 3E and 3F, multiple views of a layer of dielectric material according to another aspect of the present invention are illustrated. Layer of dielectric material 314 includes support ridges such as support ridge 314A and alignment grooves such as alignment groove 314B. While the layers of dielectric material illustrated in FIGS. 3A-3F have been depicted with support structures and alignment structures which are disposed circumferentially around the outer edge of the layers of dielectric material, support structures and alignment structures according to another aspect of the present invention may be evenly distributed throughout the surface of a layer of dielectric material, or concentrated generally in the center of a layer of dielectric material, or disposed in any other manner as may be desired. Further, the present invention is not limited to support structures which take the form of ridges, rims, or columns, but may in alternate aspects be implemented with support structures of nearly any shape, and with corresponding alignment structures for coupling with those support structures.

Figure 4:
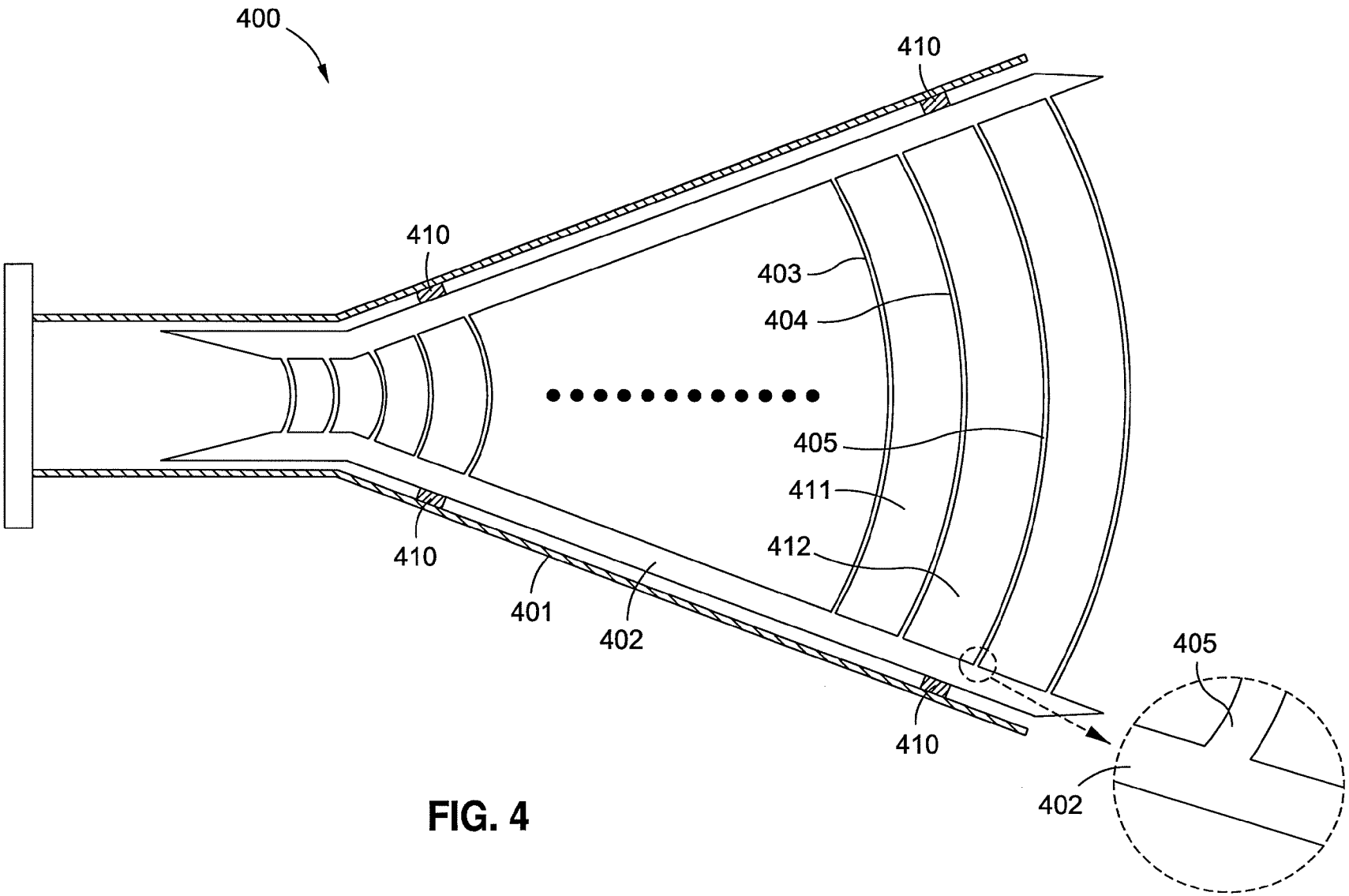
FIG. 4 illustrates a simplified diagram of a horn antenna according to yet another aspect of the present invention.

Turning now to FIG. 4, an axial cut-away view of a simplified diagram of a horn antenna is shown in accordance with another aspect of the present invention. Horn antenna 400 includes a conducting horn 401, within which are disposed a plurality of layers of dielectric material, such as dielectric layers 403, 404 and 405. Each of the layers of dielectric material, such as layers 403, 404 and 405, has a dielectric constant. Layers of dielectric material 403, 404 and 405 may be separated from conducting horn 401 by spacers, such as spacers 410. Between every pair of layers of dielectric material are disposed spacing layers, each of which has a dielectric constant which is lower than the dielectric constant of any of the layers of dielectric material. In this exemplary embodiment, spacing layer 411 is interposed between layers of dielectric material 403 and 404, and spacing layer 412 is interposed between layers of dielectric material 404 and 405.

Horn antenna 400 further includes dielectric liner 402, which is disposed between conducting horn 401 and the layers of dielectric material such as layers 403, 404 and 405. Dielectric liner 402 is separated from the horn wall by spacers 410. Dielectric liner 402 has a dielectric constant. According to one embodiment, dielectric liner 402 has a dielectric constant which is higher than the overall dielectric constant of the artificial dielectric structure defined by the plurality of layers of dielectric material and plurality of spacing layers, to provide a uniform aperture distribution and a high gain for horn antenna 400. In alternate embodiments, the dielectric liner may have a dielectric constant which is the same as or lower than the overall dielectric constant of the artificial dielectric structure. In other embodiments, the dielectric liner may have a dielectric constant which is the same as the dielectric constant of one or more layers of dielectric material.

In the present exemplary embodiment, layers of dielectric material 403, 404 and 405 are configured substantially as partial spheres. In alternate embodiments, layers of dielectric material may be substantially planar surfaces, partial ellipsoids, may change shape in abrupt steps or may include a number of angled surfaces.

Figure 5:
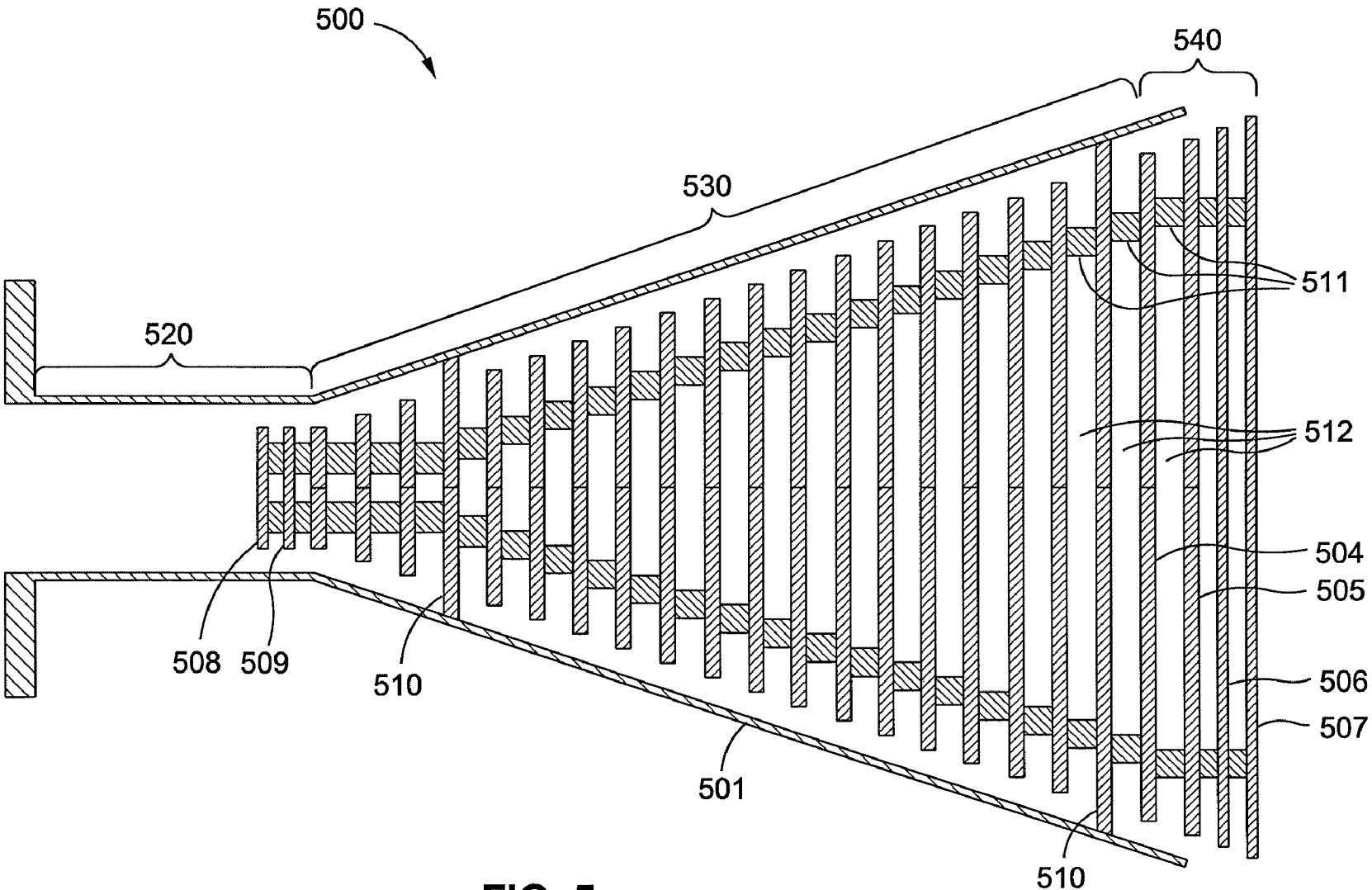
FIG. 5 illustrates a simplified diagram of a horn antenna according to yet another aspect of the present invention.

Turning now to FIG. 5, a simplified diagram of a horn antenna according to yet another aspect of the present invention is illustrated. Horn antenna 500 includes a conducting horn 501, which has an aperture 540, a tapering region 530, and a throat 520. Within conducting horn 501 are disposed a plurality of layers of dielectric material, such as dielectric layers 504 and 505. Each of the layers of dielectric material, such as layers 504 and 505, has a dielectric constant. Between every pair of layers of dielectric material are disposed spacing layers such as spacing rings 511, each of which has a dielectric constant which is lower than the dielectric constant of any of the layers of dielectric material. Spacing layers such as spacing rings 511 may include a material chosen from a group of materials with low dielectric constants such as foam, honeycomb, or the like. Alternating layers of dielectric material and spacing rings 511 define gaps 512, which may be, for example, air-filled gaps or vacuum gaps.

Horn antenna 500 may also include one or more impedance matching layers, such as matching layers 506, 507, 508 and 509. Matching layers may include, for example, one or more layers of dielectric material disposed near aperture 540 or throat 520. In one embodiment, matching layers 506 and 507 near aperture 540 have a dielectric constant between the overall dielectric constant of the artificial dielectric antenna structure within horn antenna 500 and the dielectric constant of the ambient air or vacuum in which horn antenna 500 is located. In one embodiment, matching layers 506 and 507 have a axial width of about one-quarter wavelength (¼λ) of the dielectric material of which they are formed.

The artificial dielectric antenna structure thus defined by alternating layers of dielectric material and spacing layers may be separated from conducting horn 501 by spacers such as spacer discs with outer spokes 510.

In the present exemplary embodiment, layers of dielectric material such as layers 504 and 505 are disposed in conducting horn 501 in such as way as to have a linear taper. In an alternate embodiment, the layers of dielectric material could be configured to have a non linear taper, multiple interleaved linear or non-linear tapers, or no taper at all.

Figure 6:
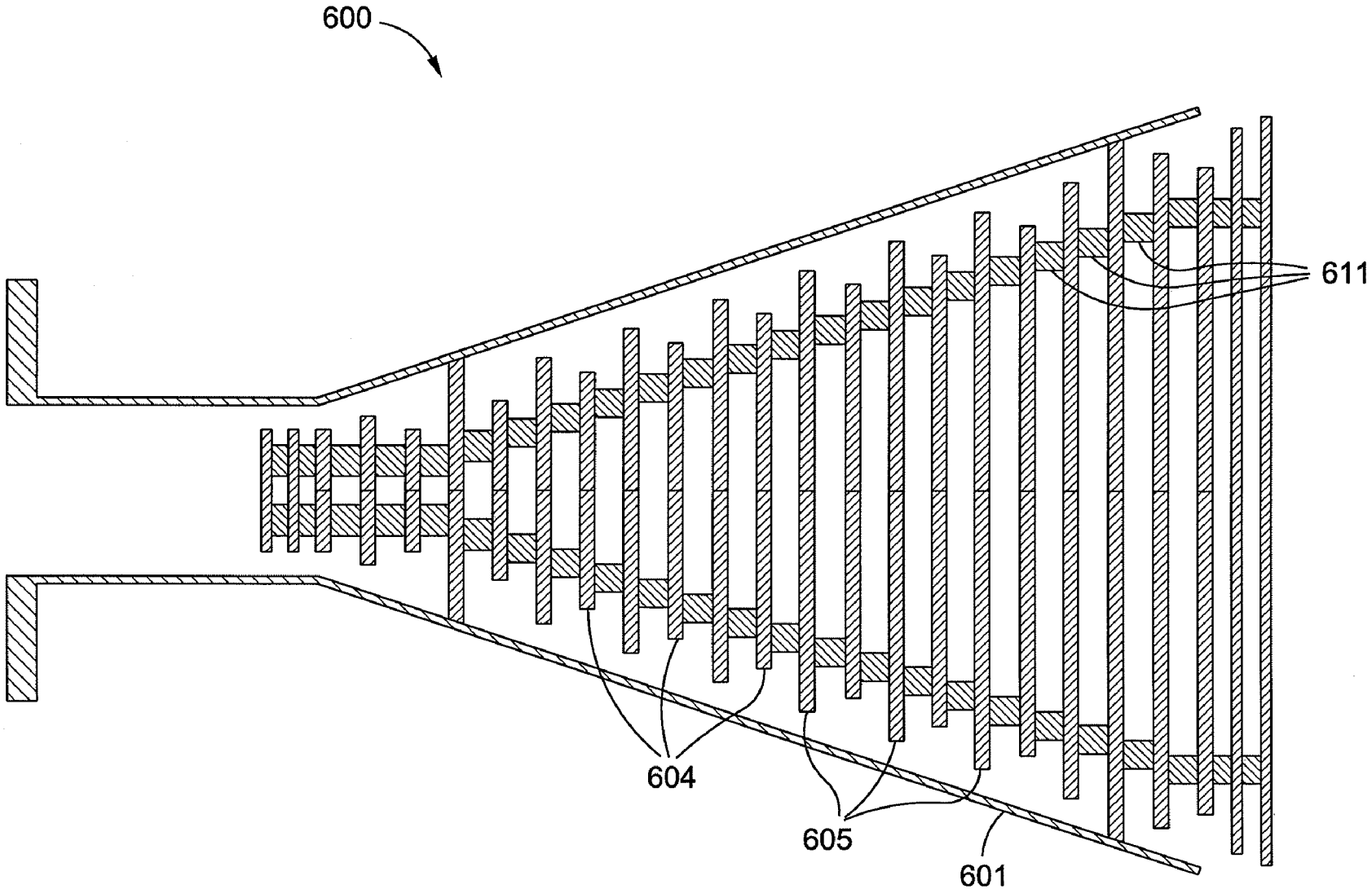
FIG. 6 illustrates a simplified diagram of a horn antenna according to yet another aspect of the present invention.

Turning now to FIG. 6, a simplified diagram of a horn antenna according to yet another aspect of the present invention is illustrated. Horn antenna 600 includes conducting horn 601, and a plurality of layers of dielectric material, such as layers 604 and 605. Between every pair of layers of dielectric material are disposed spacing layers such as spacing rings 611, each of which has a dielectric constant which is lower than the dielectric constant of any of the layers of dielectric material. In the present exemplary embodiment, the plurality of layers of dielectric material are arranged to have two interleaved linear tapers, whereby layers of dielectric material 604 have one linear taper, and layers of dielectric material 605 have a different linear taper. In alternate embodiments, the layers of dielectric material may have multiple interleaved non-linear tapers, a single linear or non-linear taper, or no taper at all.

Figure 7A:
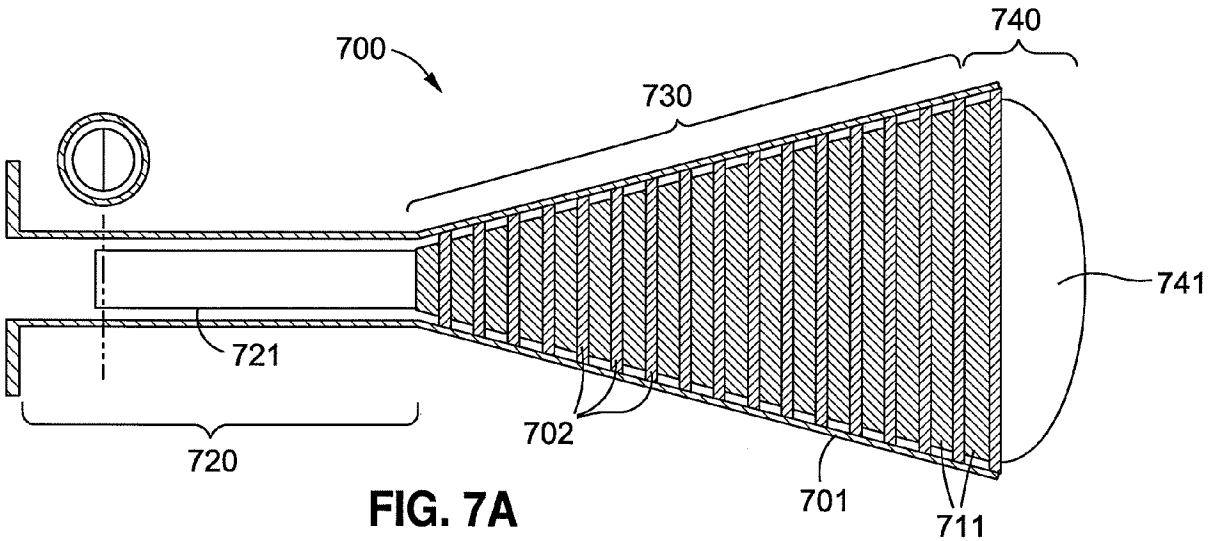
FIGS. 7A and 7B illustrate different perspectives of a simplified diagram of a horn antenna according to yet another aspect of the present invention.
Figure 7B:
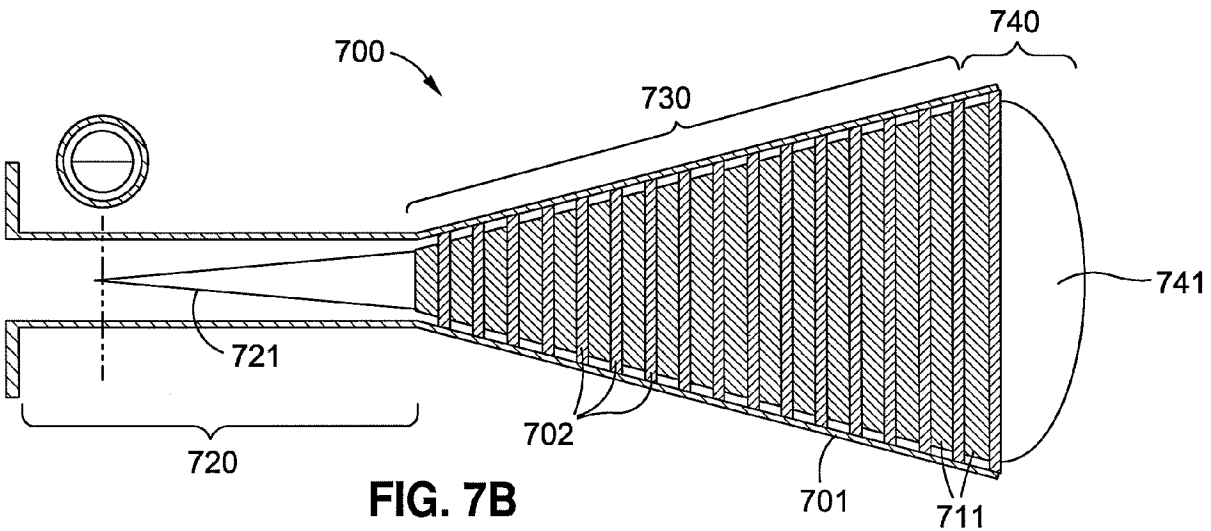

Turning now to FIGS. 7A and 7B, different perspectives of a simplified diagram of a horn antenna according to yet another aspect of the present invention are illustrated. Horn antenna 700 includes a conducting horn 701 having a throat 720, a tapering region 730, and an aperture 740. Horn antenna 700 further includes a plurality of layers of dielectric material 702. Between every pair of layers of dielectric material are disposed spacing layers such as spacing layers 711, each of which has a dielectric constant which is lower than the dielectric constant of any of the layers of dielectric material.

Horn antenna 700 further includes a polarizer 721 disposed within throat 720. As can be seen by comparing FIGS. 7A and 7B, the cross-sectional configuration of polarizer 721 differs depending on the plane along which the cross-section is taken. For example, FIG. 7A depicts a generally rectangular configuration of polarizer 721. A cross-section taken at a 90 degree angle relative to FIG. 7A is shown in FIG. 7B. In this plane, polarizer 721 has a generally wedge-shaped configuration.

In a particular embodiment, polarizer 721 includes a dielectric material having the same dielectric constant of at least one of the layers of dielectric material 702. In alternate embodiments, polarizer 721 may include a dielectric material with a dielectric constant higher than or lower than at least one of the layers of dielectric material 702.

In one embodiment, the shape and length of polarizer 721 is designed so that polarizer 721 creates a desired phase shift between the two linear components of the electric field in the throat. Linear polarization occurs when a zero degree phase difference exists between the two orthogonal field vector components, while circular polarization occurs when a ninety degree phase difference exists between the two vector components.

Horn antenna 700 may further include a phase correcting lens 741. The shape of lens 741 is designed to help focus, or defocus, the signals. In one embodiment, phase correcting lens includes one or more impedance matching layers (not shown). In a particular embodiment, lens 741 provides for phase shaping to correct for phase errors and produce improved or maximized directivity.

Figure 8:
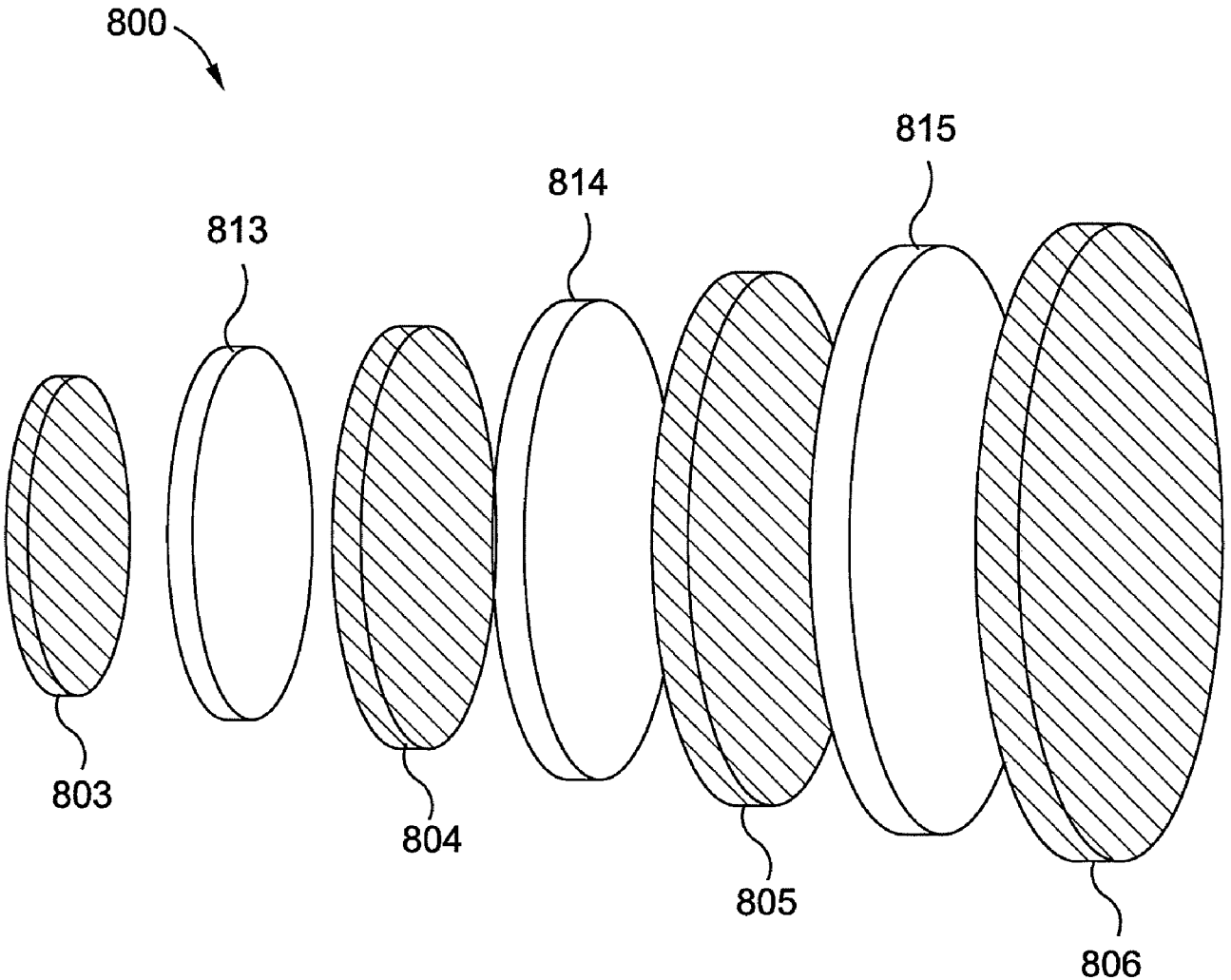
FIG. 8 illustrates an exploded view of an artificial dielectric antenna structure according to another embodiment of the present invention.

Turning now to FIG. 8, an exploded view of an artificial dielectric antenna structure according to another embodiment of the present invention is illustrated. Artificial dielectric antenna structure 800 includes a plurality of layers of dielectric material, such as layers 803, 804, 805 and 806, each of which layer has a dielectric constant. Between every pair of layers of dielectric material are disposed spacing layers, such as spacing layers 813, 814, and 815, each of which has a dielectric constant which is lower than the dielectric constant of any of the layers of dielectric material.

According to one embodiment, the layers of dielectric material may include a material chosen from a group of materials such as polystyrene, polyethylene, Teflon®, or the like. In an alternate embodiment, the layers of dielectric material may include a high-dielectric material, such as, for example, alumina ($Al_2O_3$). It will be appreciated by those skilled in the art that alternative materials also may be used within the scope of the present invention.

According to one embodiment, the spacing layers may include a material chosen from a group of materials with low dielectric constants such as foam, honeycomb, or the like. The spacing layers may be designed to define a gap, which may be filled with air in one embodiment, or may be a vacuum gap, in an embodiment in which artificial dielectric antenna structure 800 is used in a vacuum, such as in space. In a particular embodiment, spacing layers such as spacing layers 813, 814 and 815 include a material having a lower dielectric constant than the material used for any of the plurality of layers of dielectric material.

In the present exemplary embodiment, layers of dielectric material 803, 804, 805 and 806 are substantially planar and parallel. In alternate embodiments, layers of dielectric material may be partial spheres or partial ellipsoids, and may curve smoothly or in abrupt steps.

Figure 9B:
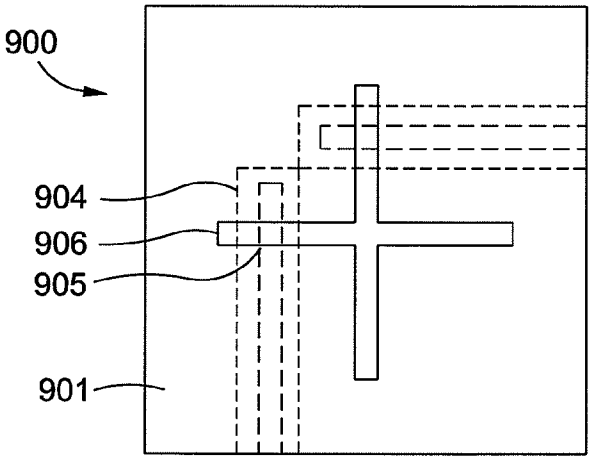
FIGS. 9A-9C illustrate simplified diagrams of several views of dielectric resonator antennas according to yet another embodiment of the present invention.
Figure 9A:
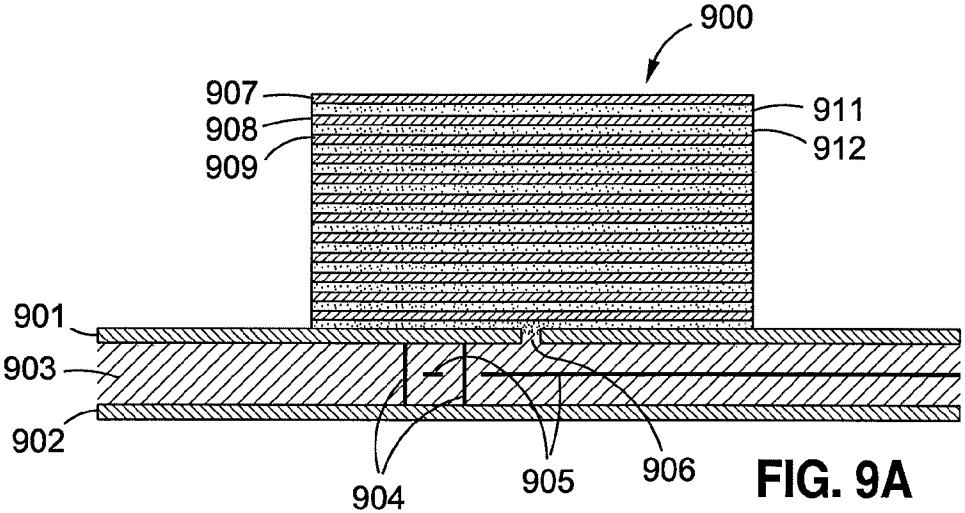

Turning now to FIGS. 9A and 9B, simplified diagrams of several views of a dielectric resonator antenna according to yet another embodiment of the present invention are illustrated. FIG. 9A provides a cross-sectional view, while FIG. 9B provides an overhead view of a dielectric resonator antenna 900.

A dielectric resonator antenna such as dielectric resonator antenna 900 may include a first ground plate such as a ground plate 901 and a second ground plate such as a ground plate 902. Dielectric resonator antenna 900 may further include a dielectric material such as a dielectric material 903 disposed between ground plate 901 and ground plate 902. Dielectric resonator antenna 900 may further include a slot feed such as a slot feed 906 and one or more striplines, such as striplines 905. Dielectric resonator antenna 900 may further include a via fence such as a via fence 904.

According to one embodiment, layers of dielectric material, such as layers 907, 908 and 909, are disposed substantially parallel to ground plate 901 above slot feed 906. Between every pair of layers of dielectric material are disposed spacing layers, such as spacing layers 911 and 912, each of which has a dielectric constant which is lower than the dielectric constant of any of the layers of dielectric material.

Figure 9C:
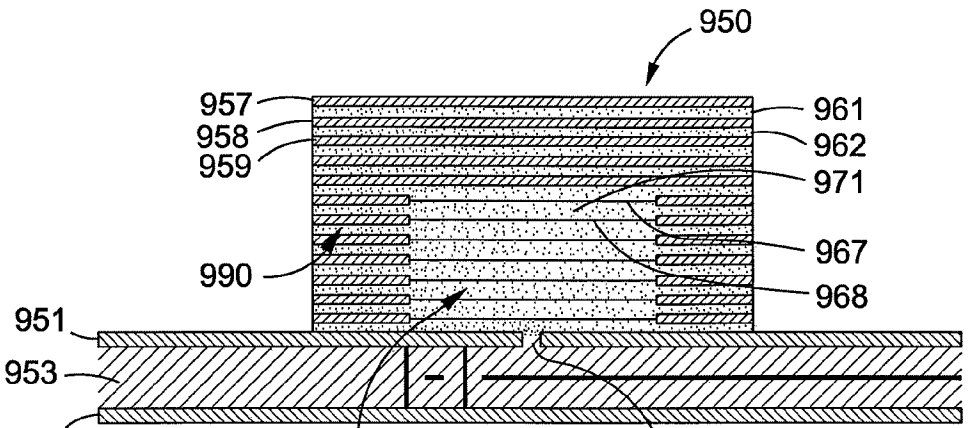

According to an alternate embodiment illustrated in FIG. 9C, a dielectric resonator antenna 950 according to the present invention may include more than one artificial dielectric antenna structure, each of which has a different overall dielectric constant. Dielectric resonator antenna 950 includes a first ground plate such as a ground plate 951 and a second ground plate such as a ground plate 952. Dielectric resonator antenna 950 further includes a dielectric material such as a dielectric material 953 disposed between ground plate 951 and ground plate 952. Dielectric resonator antenna 950 may further include a slot feed such as a slot feed 956.

Layers of dielectric material, such as layers 967 and 968 are disposed substantially parallel to ground plate 951 above slot feed 956. Between every pair of layers of dielectric material are disposed spacing layers, such as a spacing layer 971, which has a dielectric constant which is lower than the dielectric constant of any of the layers of dielectric material. Configured as a shell around this first artificial dielectric antenna structure 980 is another artificial dielectric antenna structure 990, including layers of dielectric material 957, 958 and 959. Between every pair of layers of dielectric material are disposed spacing layers, such as spacing layers 961 and 962, which have a dielectric constant which is lower than the dielectric constant of any of the layers of dielectric material. A layer of dielectric material of the first artificial dielectric antenna structure 980 and a layer of material of the second artificial dielectric antenna structure 990 may be mechanically coupled, or may alternately be machined from a single piece of dielectric, in which one region, which may be in the center, is thinned.

While the present invention has been particularly described with reference to the various figures and embodiments, it should be understood that these are for illustration purposes only and should not be taken as limiting the scope of the invention. There may be many other ways to implement the invention. Many changes and modifications may be made to the invention, by one having ordinary skill in the art, without departing from the spirit and scope of the invention.

What is claimed is:

1. A horn antenna comprising:

a conducting horn having an aperture, a throat and a longitudinal axis;

a plurality of layers of dielectric material disposed within the conducting horn and substantially normal to the longitudinal axis of the horn, each of the plurality of layers of dielectric material having a dielectric constant; and a plurality of spacing layers interposed between the plurality of layers of dielectric material, each of the plurality of spacing layers having a dielectric constant lower than the dielectric constant of any of the plurality of layers of dielectric material.

2. The horn antenna of claim 1, wherein the plurality of layers of dielectric material are separated from the conducting horn by a plurality of spacers.

3. The horn antenna of claim 1, further comprising a dielectric liner disposed between the plurality of layers of dielectric material and the conducting horn, said dielectric liner separated from the conducting horn by a plurality of spacers.

4. The horn antenna of claim 3, wherein each of the plurality of layers of dielectric material is disposed with a corresponding groove in the dielectric liner.

5. The horn antenna of claim 3, wherein the plurality of layers of dielectric material comprise the same material as the dielectric liner.

6. The horn antenna of claim 1, wherein each of the plurality of layers of dielectric material has the same dielectric constant as every other of the plurality of layers of dielectric material.

7. The horn antenna of claim 1, wherein the dielectric constant of a first one of the plurality of layers of dielectric material is different from the dielectric constant of a second one of the plurality of layers of dielectric material.

8. The horn antenna of claim 1, wherein the plurality of layers of dielectric material are substantially parallel.

9. The horn antenna of claim 1, wherein each of the plurality of layers of dielectric material is substantially planar.

10. The horn antenna of claim 1, wherein each of the plurality of layers of dielectric material is shaped substantially as a partial sphere.

11. The horn antenna of claim 1, wherein each of the plurality of layers of dielectric material has a shape which curves in abrupt steps.

12. The horn antenna of claim 1, wherein at least one of the plurality of layers of dielectric material includes a support rim extending axially substantially around an outer edge of the at least one of the plurality of layers of dielectric material.

13. The horn antenna of claim 1, wherein the horn antenna is configured to have a maximum bandwidth.

14. The horn antenna of claim 1, wherein the horn antenna is configured to have a high gain for a given aperture size.

15. The horn antenna of claim 1, further comprising an impedance matching layer near the aperture of the conducting horn.

16. The horn antenna of claim 1, further comprising an impedance matching layer near the throat of the conducting horn.

17. The horn antenna of claim 1, further comprising a polarizer disposed in the throat.

18. The horn antenna of claim 1, further comprising a phase correcting lens.

19. The horn antenna of claim 1, wherein the plurality of layers of dielectric material are coated with germanium (Ge).

20. The horn antenna of claim 1, wherein the plurality of layers of dielectric material are arranged to have a non-linear taper.

21. The horn antenna of claim 1, wherein the aperture has a shape chosen from a group including circular, elliptical, square, rectangular and hexagonal shapes.

* * * * *